US005971083A

United States Patent [19]

Wiklund

[11] Patent Number: 5,971,083

[45] Date of Patent: Oct. 26, 1999

[54] PRESSURE FLUID OPERATED IMPACT MECHANISM

[76] Inventor: Henry Wiklund, Backvagen 1, S-820 10 Arbra, Sweden

[21] Appl. No.: 09/115,480

[22] Filed: Jul. 15, 1998

[30] Foreign Application Priority Data

Aug. 7, 1997 [SE] Sweden ..... 9702877

[51] Int. Cl.[6] ..... B25D 9/00

[52] U.S. Cl. ..... 173/19; 173/13; 173/121; 173/204; 173/211

[58] Field of Search ..... 173/13, 17, 121, 173/204, 211, 118, 15, 51, 58, 59, 77

[56] References Cited

U.S. PATENT DOCUMENTS

| | | | |
|---|---|---|---|
| 2,786,451 | 3/1957 | Dulaney | 173/204 |
| 3,592,275 | 7/1971 | Fletcher | 173/58 |
| 4,605,073 | 8/1986 | Nilsson et al. | 173/51 |
| 4,609,054 | 9/1986 | Nilsson et al. | 173/118 |
| 5,080,179 | 1/1992 | Gien et al. | 173/17 |
| 5,755,292 | 5/1998 | Nilsson et al. | 173/121 |

FOREIGN PATENT DOCUMENTS

| | | |
|---|---|---|
| 406875 | 3/1979 | Sweden . |
| 9411160 | 5/1994 | WIPO . |

*Primary Examiner*—Peter Vo
*Assistant Examiner*—James P Calve
*Attorney, Agent, or Firm*—Mark P. Stone

[57] ABSTRACT

Pressure fluid operated impact mechanism having a reciprocating working member (5), a stop member (17) and, formed between said members, a drive chamber (18) with seals (15, 16) and a regulating valve (21) co-operating with a supply opening (25) for pressure fluid, in which opening a sleeve (24) can be arranged for the journalling of the valve. The valve blocks the opening when the working member (5) and the stop member (17) have moved a distance away from each other and is open when they are close to each other. Through the valve and the working member, a discharge channel (33, 31, 20, 32) for pressure fluid is provided which is closed when its inlet opening (33) is inside the stop member and is freed when the working and stop members have moved a distance away from each other.

9 Claims, 1 Drawing Sheet

PRESSURE FLUID OPERATED IMPACT MECHANISM

The present invention relates to a pressure fluid operated impact mechanism of the type which comprises a working member arranged to reciprocate in relation to a stop member which can also describe a reciprocating movement, and at least one sealing member co-operating with the first-mentioned members to form a drive chamber between those. Pressure fluid is supplied to the drive chamber through an opening in the stop member, and forming part of the drive mechanism is also a regulating valve which in the region of a rear end position of the movement of the working member is open for the supply of pressure fluid to the drive chamber and which in the region of a forward end position of said movement blocks said supply. Furthermore, a spring is arranged to press the working member against the stop member, and if the latter is movably arranged it, too, can be fitted with a spring which presses it against the working member; i.e. in this case the two springs press the two members against each other.

An impact mechanism of the said type operates in such a way that the working member, acted upon by the pressure fluid, makes a forward movement during the first stage of which the regulating valve is open for the supply of pressure fluid to the drive chamber, which is otherwise closed by the seal or seals. During a second stage the supply of pressure fluid is stopped, and the drive chamber is opened for the discharge of pressure fluid. The forward movement of the working member is interrupted and replaced by a return movement. At the final stage of this movement the drive chamber is again closed, and the regulating valve opens for renewed supply of pressure fluid and a new forward movement. If the stop member is also movably arranged, it will make a rearward movement simultaneously with the forward movement of the working member, and vice versa.

STATE OF THE ART

Impact mechanisms of the abovementioned type are known, in which the drive chamber is emptied radially—see for example the Swedish patent No. 501 449. In these mechanisms, a ring-shaped opening must be provided between a housing enclosing the mechanism and the peripheral walls of the mechanism's drive chamber, so that pressure fluid can pass through this opening towards one or more discharge openings provided in the tool. This results in increased diameter of the tool housing which, for one thing, increases the price of the tool and, for another thing, results in an undesired weight increase. A larger dimension entails an increased cost of material, but above all it entails a more complicated design and increased machining cost, as it is not suitable to use the same large diameter for other portions of the tool as the one required in the region of the drive chamber, since the tool would be both unwieldier to hold and heavy. This applies, to a particularly high degree, to tools which are larger than the one exemplified in the abovementioned patent No. 501 449, such as for example the scaling hammer exemplified in the present patent application. For comparison with the latter, reference is also made to the published Swedish patent application No. 406 875, FIG. 1, which shows a scaling hammer having an impact mechanism which is not fitted with the abovementioned regulating valve but which is otherwise of the type described above.

ADVANTAGES OF THE PRESENT INVENTION

With the impact mechanism in accordance with the present invention it is possible to reduce the tool housing diameter and thereby, without rendering the tool to be uncomfortably thick to hold, to make both the gripping part of the tool and the portion around the impact mechanism with the same diameter and with a simple tubular shape which requires a minimum of machining. Weight is saved, and the manufacturing cost is reduced considerably. The guiding of the working member and stop member against each other is improved, and the sealing of the drive chamber is also simplified, as will be shown more in detail from the following specification.

These advantages have been attained with the impact mechanism in accordance with the present invention as it is defined in Claim 1.

BRIEF DESCRIPTION OF THE DRAWINGS

The impact mechanism in accordance with the present invention is described in closer detail in the following, with reference to the attached drawing.

In FIG. 1, the working member and stop member of the mechanism are shown in a position in which they are moved together, and FIG. 2 shows the position which they assume at the final stage of a parting movement.

DESCRIPTION OF AN EMBODIMENT OF THE INVENTION

Figure 1:
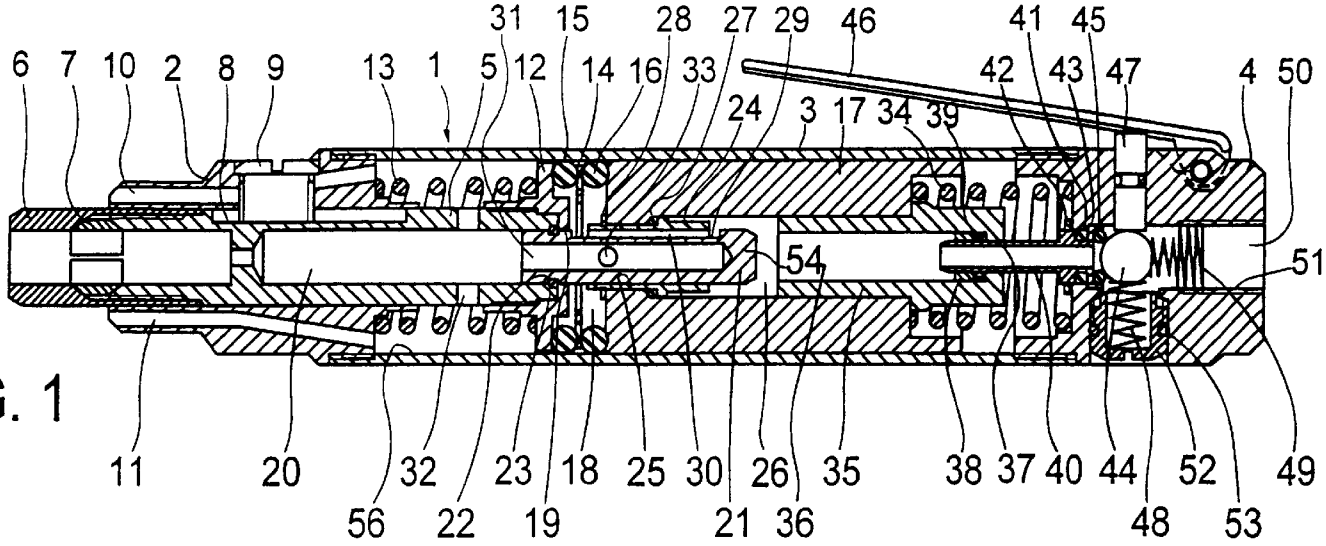
FIG. 1 of the drawing shows a sectioned side view of an embodiment in the form of a pressure fluid operated scaling hammer provided with the mechanism in accordance with the invention.

In the drawing, the numeral 1 designates the tool housing, 2 is the front part of the housing, 3 a middle part screwed on to the front part, and 4 is a rear part screwed together with the middle part. In the front part, a working member 5 is journalled which at its front end is fitted with a nut 6 and a slotted clamping ring 7 for retaining a chisel or the like, not shown. The working member is made with a planed surface 8 with which a flat end of a screw 9 co-operates to prevent turning of the working member. In the front part, discharge openings 10, 11 are provided for pressure fluid leaving the drive chamber of the tool. The opening 10 and the screw 9 are of course, in practice, unlike what is shown from the drawing, displaced laterally in relation to each other, so that the screw is not blocking the opening.

At the rear end of the working member 5, a drive plate 12 is fitted. Against one end surface of the plate a spring 13 is supported, and between the plate's opposite end surface and one side of an intermediate ring 14 a seal ring 15 is arranged. One more seal ring 16 is arranged between the opposite side of the intermediate ring and a stop member 17 which is movably journalled in the middle part 3 of the housing, a sealed drive chamber 18 thereby being formed between the drive plate and the stop member.

Through a hole 19 in the drive plate 12 and into a bore 20 in the working member 5 one end of a regulating valve 21 is inserted. In a groove in the valve, an elastic seal ring 22 is arranged which is retained against a widened portion 23 of the bore 20 and an end surface of the drive plate 12 facing the seal ring, the hole 19 of the drive plate having a smaller diameter than the portion 23.

The regulating valve 21 extends into a sleeve 24 arranged in an opening 25 which forms a narrower portion of a bore 26 in the stop member. The sleeve 24 is with the help of a flexible seal ring 27 and a lock ring 28 retained in the opening 25 with a play against the latter. The regulating valve 21 and the sleeve 24 can adjust their positions in relation to each other, as they are arranged with a play and as the seal rings 22 and 27 are flexible. In this way, a close fit can be used between the valve and the sleeve, so that they seal well against each other. Without this adjustability, such a close fit would require a very exact centering of the valve in the sleeve (or direct in the opening 25), which it is difficult to obtain.

The regulating valve 21 has a cylindrical rear portion 54 having a smaller diameter than the bore 26 and, as mentioned above, a close fit in the sleeve 24. A middle portion of the valve has a plane portion 29 on at least one side or two opposite sides, said plane forming an opening 30 against the inner wall of the sleeve. The valve is furthermore provided with a bore 31 which communicates with the bore 20 of the working member and two holes 32 in same. At right angles to the bore 31 of the regulating valve and without communicating with the plane or planes 29, a hole is made through the valve to form an inlet opening 33 to the bore 31. The hole can be a through-bore, so that two inlets are formed.

Between the rear end of the stop member 17 and an end surface of the rear part 4 of the housing, a spring 34 is provided. The rear end of the bore 26 of the stop member is fitted with a bushing 35 which has a bore 36 ended by a narrower portion 37. Inside the portion 37, a member 38 is provided which forms a seating for a seal ring 39. Through the portion 37, the member 38 and the seal ring 39, one end of a tube 40 is inserted which with an opposite end is inserted into the rear part 4 and sealed against it with the help of a seal ring 41. The tube is retained in the rear part 4 by a lock ring 42 and a shoulder 43 against which an end portion of the tube having an enlarged diameter supports. In this end portion and against a valve ball 44, one more seal ring 45 is provided. A trigger 46, a piston 47 and springs 48, 49 co-operate to move the valve ball out of and into a sealing position against the seal ring 45. At the rear end of the rear part 4, an inlet opening 50 for pressure fluid is provided which has a connecting thread 51 for the connection of a hose nipple with hose (not shown) for pressure fluid. The spring 48 is arranged in a hollow screw 52 which is threaded into the rear part 4 and fitted with a seal ring 53. The spring 49 has a tightly-wound rear portion and a narrowing front portion wound with a larger pitch, which fits against the valve ball 44.

Mode of Operation

The exemplified tool having the impact mechanism in accordance with the present invention functions in the following way:

When the valve ball 44 is pushed aside as the trigger 46 is pressed downwards, pressure fluid flows via the tube 40, the bores 36, 26 and the opening 30 in the sleeve 24 past the plane portion 29 of the regulating valve 21 into the drive chamber 18. A parting movement of the working member 5 and the stop member 17 is started. During the first stage of the movement, the inlet 33 in the regulating valve is blocked by the sleeve 24 enclosing the valve, and rear portion 54 of the valve has not yet reached and blocked the sleeve but permits pressure fluid to flow into it.

During the next stage, the rear valve portion 54 blocks the sleeve, and the inlet 33 of the valve leaves it and is free inside the drive chamber 18, so that pressure fluid flows out of the chamber via the valve bore 31, the bores 20, 32 of the working member and the exhaust openings 10, 11 in the front part 2 of the housing. The parting movement is interrupted, and the working and stop members 5, 17 are returning towards each other by the springs 13, 34, until the valve's inlet 33 again moves into the sleeve and is blocked, and the rear valve portion 54 moves out of the sleeve and permits a new flow of pressure fluid through it which starts a new parting movement.

Figure 2:
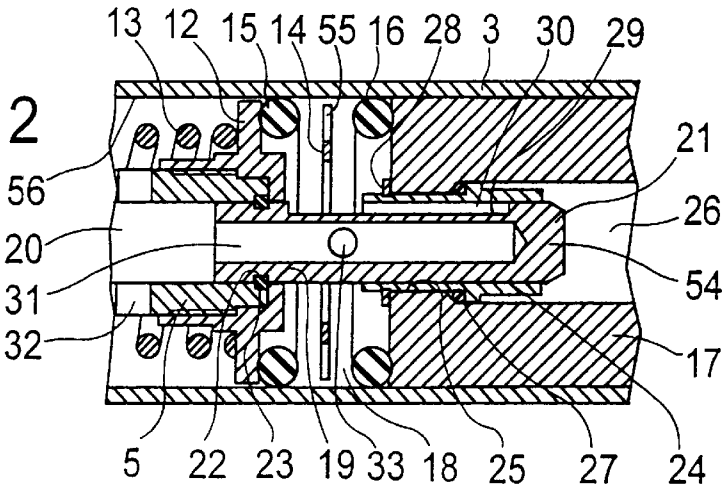
FIG. 2 shows a sectioned side view of a portion of the tool on an enlarged scale.

The intermediate ring 14 of the drive chamber is provided around its circumference with a number of openings or recesses 55 in its contact surfaces against the seal rings 15, 16. When the drive chamber is pressurized, the pressure fluid acts against the portions of the seal rings which are freed by the openings or recesses, while on their opposite side the seal rings support against the drive plate 12 and the stop member 17, respectively, with no corresponding interruptions in their contact surfaces. This results in the seal rings being kept pressed, by the pressure fluid, against their respective members 12, 17 and accompanying these in their parting movement—see FIG. 2—and the thereafter following return movement. The seal rings are by the pressure fluid also kept in contact with the inner wall 56 of the middle part 3 of the housing, so that sealing is maintained all the time between the wall 56 and the working and stop members, respectively.

It is possible to arrange the regulating valve 21, in the way known earlier, direct in the opening 25 of the working member without the use of any sleeve 24, in which case one has to resort only to the adaptability which the flexible retaining of the regulating valve in the working member 5 offers.

Closer Description of the Advantages

With the impact mechanism in accordance with the invention, a number of advantages are obtained:

The stop member 17 can be journalled direct in the middle part 3 of the housing along its entire length, which provides for a good guiding of it and a simple design.

The drive plate 12 can be arranged with a play of a few tenths of a millimeter against the inner wall 56 of the housing with no harmful effect on the sealing function, provided that a sufficiently thick seal ring 15 is chosen which is not pressed out into the clearance between the drive plate and the wall. This, together with the adjustability of the regulating valve 21 and the sleeve 24 against each other, reduces the requirement for a high precision in the guiding of the working member 5 and the stop member 17 in relation to each other.

The mentioned adjustability also makes it possible to make the regulating valve with a close fit in the sleeve 24, so that the valve's inlet 33 for discharged pressure fluid is well sealed when it is inside the sleeve.

The seal rings 15, 16 are subjected to a minimum of deformation and wear, as they require no pretensioning but can have the same outer diameter as the diameter of the inner wall 56 of the housing and are arranged freely between the working and stop members 5, 17.

The diameter and weight of the tool can be reduced and its manufacturing cost lowered through a reduced cost of material and a simplified shape of its housing which lowers the machining cost.

I claim:

1. A pressure fluid operated impact mechanism comprising a reciprocating working member (5) movable towards and away from a stop member (17) which is reciprocally mounted relative to said working member, and at least one sealing member (15, 16) cooperating with said working member and said stop member to form a drive chamber (18) therebetween to which chamber pressure fluid is supplied through an opening (25) in the stop member (17); a regulating valve member (21) connected at one end to and movable with said working member (5), an opposite end of said regulating valve member (21) extending into the opening of said stop member (25), said regulating valve member (21) permitting a supply of pressure fluid to flow to the drive chamber (18) when the working member (5) is in the region of an end position of said movement towards said stop member, and blocking said supply when the working member (5) is in the region of an end position of said movement away from said stop member; a first spring (13) arranged to bias the working member (5) in a direction towards the stop member (17), and a second spring (34) arranged to bias the stop member (17) in a direction towards said working member (5) so as to reciprocate said stop member relative to said working member; wherein an exhaust channel (33, 31, 20, 32) from the drive chamber (18) is provided through the regulating valve member (21) and the working member (5), at least one inlet (33) to said exhaust channel being provided in the regulating valve member (21) in such a way that said at least one inlet (33) is inside the stop member (17) and is blocked from fluid communication when the working member (5) is in the region of said end position of its movement towards said stop member, and that said at least one inlet (33) is inside the drive chamber (18) for permitting a flow of pressure fluid from said drive chamber (18) when the working member (5) is in the region of said end position of its movement away from said stop member.

2. The impact mechanism in accordance with claim 1, wherein a sleeve (24) for the journalling of the regulating valve member (21) is received in said opening of said stop member (17), the relative dimensions of said sleeve and said opening permitting movement of said sleeve relative to said opening; a flexible member being provided for retaining said sleeve in said opening and for limiting the movement of said sleeve relative to said opening; said blocking of the inlet (33) of the regulating valve member (21) resulting from said inlet (33) being located inside said sleeve (24) when the working member (5) is in the region of said end position of its movement towards said stop member.

3. The impact mechanism in accordance with claim 2, wherein two sealing members (15, 16) are provided in the drive chamber (18), each of said sealing members having a first side, a second opposite side, and a peripheral surface; each of said sealing members supporting with said first side against supporting surfaces of an intermediate ring (14) provided between said sealing members, and with said second opposite side against supporting surfaces along an end surface of the working member (5) and the stop member (17), respectively, and also supporting with said peripheral surface against an inner wall (56) of a housing (1) enclosing said impact mechanism; the supporting surfaces of the intermediate ring (14) against the sealing member (15, 16) being smaller than the supporting surfaces of the working member (5) and the stop member (17) against said sealing members (15, 16); the sealing members (15, 16), as a result of the action of the pressure fluid, being held constantly pressed against the larger supporting surfaces of the working and stop members (5, 17) during said reciprocating movement and in sealing contact with and gliding along the inner wall (56).

4. The impact mechanism in accordance with claim 3, wherein the regulating valve member (21) is flexibly connected to the working member (5) for adjusting its relative position between the opening (25) of the stop member (17) and the sleeve (24), respectively.

5. The impact mechanism in accordance with claim 2, wherein the regulating valve member (21) is flexibly connected to the working member (5) for adjusting its relative position between the opening (25) of the stop member (17) and the sleeve (24), respectively.

6. The impact mechanism in accordance with claim 2, wherein said flexible retaining member comprises a seal ring (27).

7. The impact mechanism in accordance with claim 1, wherein two sealing members (15, 16) are provided in the drive chamber (18), each of said sealing members having a first side, a second opposite side, and a peripheral surface; each of said sealing members supporting with said first side against supporting surfaces of an intermediate ring (14) provided between said sealing members, and with said second opposite side against supporting surfaces along an end surface of the working member (5) and the stop member (17), respectively, and also supporting with said peripheral surface against an inner wall (56) of a housing (1) enclosing said impact mechanism; the supporting surfaces of the intermediate ring (14) against the sealing member (15, 16) being smaller than the supporting surfaces of the working member (5) and the stop member (17) against said sealing members (15, 16); the sealing members (15, 16), as a result of the action of the pressure fluid, being held constantly pressed against the larger supporting surfaces of the working and stop members (5, 17) during said reciprocating movement and in sealing contact with and gliding along the inner wall (56).

8. The impact mechanism in accordance with claim 7, wherein the regulating valve member (21) is flexibly connected to the working member (5) for adjusting its relative position between the opening (25) of the stop member (17) and the sleeve (24), respectively.

9. The impact mechanism in accordance with claim 1, wherein the regulating valve member (21) is flexibly connected to the working member (5) for adjusting its relative position between the opening (25) of the stop member (17) and the sleeve (24), respectively.

* * * * *